US010596623B2

(12) United States Patent
Du et al.

(10) Patent No.: US 10,596,623 B2
(45) Date of Patent: Mar. 24, 2020

(54) LOW-PRESSURE CASTING SECONDARY PRESSURE PROCESS FOR ALUMINUM WHEEL

(71) Applicant: CITIC Dicastal CO., LTD, Qinhuangdao (CN)

(72) Inventors: Dexi Du, Qinhuangdao (CN); Zhihua Zhu, Qinhuangdao (CN)

(73) Assignee: CITIC DICASTAL CO., LTD, Qinhuangdao, Hebei (CN)

( * ) Notice: Subject to any disclaimer, the term of this patent is extended or adjusted under 35 U.S.C. 154(b) by 0 days.

(21) Appl. No.: 16/058,292

(22) Filed: Aug. 8, 2018

(65) Prior Publication Data

US 2019/0283124 A1 Sep. 19, 2019

(30) Foreign Application Priority Data

Mar. 13, 2018 (CN) ..... 2018 1 0204639

(51) Int. Cl.

| | |
|---|---|
| ***B22D 18/04*** | (2006.01) |
| ***B22C 9/28*** | (2006.01) |
| ***B22D 27/11*** | (2006.01) |

(52) U.S. Cl.

CPC ..... *B22D 18/04* (2013.01); *B22C 9/28* (2013.01); *B22D 27/11* (2013.01)

(58) Field of Classification Search

CPC ..... B22D 18/02; B22D 18/04; B22D 27/11; B22C 9/28

See application file for complete search history.

(56) References Cited

U.S. PATENT DOCUMENTS 5,562,147 A * 10/1996 Bortoloni ..... B22D 18/02 164/119

FOREIGN PATENT DOCUMENTS

| | | | | |
|---|---|---|---|---|
| CN | 104190899 | A | 12/2014 | |
| EP | 0273586 | A2 | 7/1988 | |
| GB | 1455626 | A * | 11/1976 | ..... B22D 18/04 |
| JP | S5847262 | B2 | 10/1983 | |
| JP | H06285610 | A | 10/1994 | |
| WO | 2017013590 | A1 | 1/2017 | |

* cited by examiner

*Primary Examiner* — Kevin E Yoon

(74) *Attorney, Agent, or Firm* — Calfee, Halter & Griswold LLP

(57) ABSTRACT

The present application discloses a low-pressure casting secondary pressure process for an aluminum wheel. The characteristics of smooth low-pressure filling of molten aluminum alloy and rapid solidification of a rim are preserved, the aluminum alloy at a center sprue is frozen by using a center sprue spreader and a forced water coolling to close a mold cavity, and secondary pressure is implemented to the aluminum wheel by means of down-movement of center extrusion rods, so that the material mechanical properties of an aluminum wheel casting and the production efficiency of the casting process are improved.

5 Claims, 4 Drawing Sheets

LOW-PRESSURE CASTING SECONDARY PRESSURE PROCESS FOR ALUMINUM WHEEL

CROSS-REFERENCE TO RELATED APPLICATIONS

This application claims priority to Chinese Patent Application No. 201810204639.X filed on Mar. 13, 2018, which is hereby incorporated by reference in its entirety.

TECHNICAL FIELD

The present application relates to a casting process, and specifically, relates to an aluminum wheel casting process.

BACKGROUND ART

The low-pressure casting process is a mainstream forming process in the aluminum wheel manufacturing industry. The conventional low-pressure casting process pressure is not more than 100 kPa, and the internal structure compactness of a casting is far lower than that of a forging process. Although the industry has implemented technological renovation on a water cooling process in recent years, it has also encountered a development bottleneck after a certain degree of improvement on material properties and casting production efficiency.

SUMMARY OF THE INVENTION

The present application provides a casting process, which solves the problems of low holding pressure during low-pressure casting and poor heat exchange between a mold and molten aluminum alloy.

The technical solution adopted by the present application is: a low-pressure casting secondary pressure process for an aluminum wheel includes low-pressure filling and secondary extrusion. Molten aluminum alloy in a holding furnace enters a mold through a center sprue under the action of compressed air, until the mold cavity is full; a center sprue spreader is lowered to be in clearance fit with a center sprue bushing, and the aluminum alloy at the center sprue is rapidly solidified by cooling the mold with water to close the mold cavity. At the same time, five center extrusion rods at corresponding positions of the wheel center of an aluminum wheel move down to apply mechanical pressure for secondary pressure feeding of the aluminum wheel to realize sequential solidification, until the molten aluminum alloy is completely crystallized and solidified, and the molds are opened to take a casting out.

According to the low-pressure casting secondary pressure process of the present application, the crystallization and solidification of the rim of the aluminum wheel are still completed under low-pressure casting holding pressure, so a low pressure holding delay stage should be set after the mold cavity is full of the molten aluminum alloy and before the center sprue spreader is lowered to seal the low pressure in the holding furnace, in which the pressure holding time is between 10 and 20 seconds.

According to the low-pressure casting secondary pressure process of the present application, the center sprue spreader is in clearance fit with the center sprue with a clearance distance of 0 to 2 mm. In the present application, the clearance fit surface of the center sprue spreader and the center sprue is a tapered surface, and in order to facilitate de-molding, the tapered angle is between 0° and 5°.

According to the low-pressure casting secondary pressure process of the present application, the molten aluminum alloy at the center sprue spreader and the center sprue needs to be rapidly frozen under a forced water cooling condition to seal the mold cavity. Before the center extrusion rods move down, a water cooling holding delay stage is set, and the delayed pressure holding time is between 10 and 20 seconds.

According to the low-pressure casting secondary pressure process of the present application, the maximum feeding pressure, acting on the molten aluminum alloy in the closed mold cavity, of the center extrusion rods may reach 1000 times the pressure feeding capacity of ordinary compressed air in low-pressure casting.

The speed of lowering the center extrusion rods is crucial to final molding and crystallization of the casting, and the lowering stage is divided into the first low speed and then high speed. Thus, no overflow flash is ensured for the casting, and forced pressure feeding is realized.

The lowering speed at the low-speed stage of the lowering process of the center extrusion rods is 0 to 0.2 mm/s. The lowering speed at the high-speed stage of the lowering process of the center extrusion rods is 0.5 to 0.8 mm/s.

Five center extrusion rods are provided in the present application, with cross section diameters of 50 mm.

Finally, in the aluminum alloy wheel manufactured by the low-pressure casting secondary extrusion process according to the present application, the low-pressure casting pressure holding time is shortened from 100s to 50s, and the production efficiency of the overall casting process is improved by 20%; the strength of the aluminum wheel casting is improved by 30%, and the yield strength of the spokes reaches 260-290 MPa; and the elongation of the spokes reaches 5%-10%.

BRIEF DESCRIPTION OF DRAWINGS

The present application will be further illustrated below in conjunction with the drawings and embodiments.

In which: 1—holding furnace, 2—bottom mold, 3—side mold, 4—top mold, 5—center sprue spreader, 6—center extrusion rod, 7—water cooling, 8—center sprue.

DETAILED DESCRIPTION OF THE INVENTION

The details and working conditions of the specific device proposed by the present application will be described below in combination with the accompanying drawings.

Figure 1:
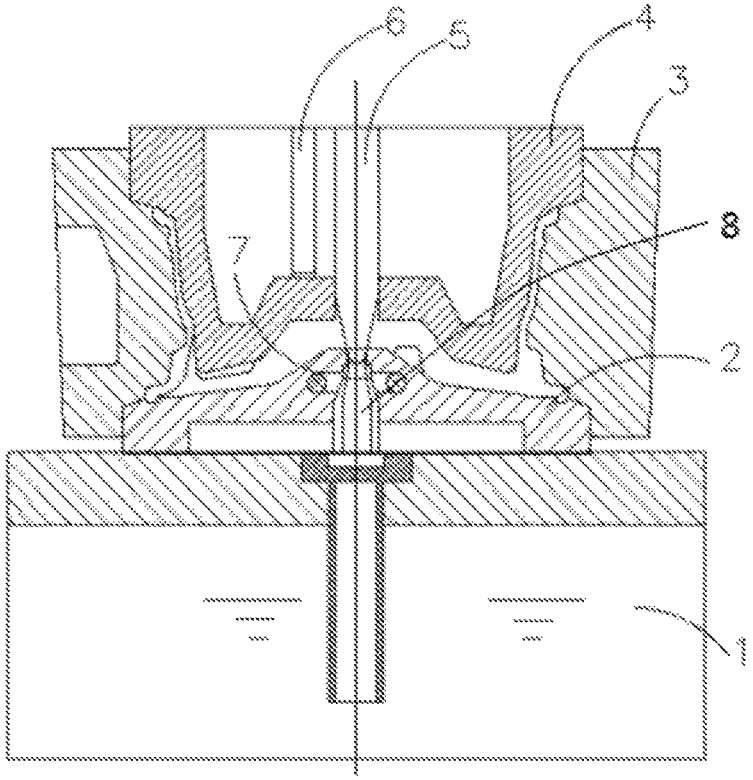
FIG. 1 is a schematic diagram of a device for a low-pressure casting secondary pressure process for an aluminum wheel according to the present application.
Figure 2:
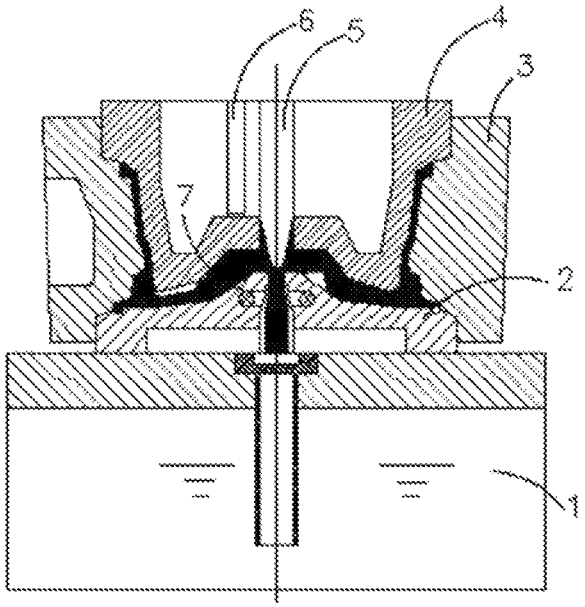
FIG. 2 is a schematic diagram of a crystallization and solidification stage of a rim after the cavity is full of aluminum alloy under low pressure.
Figure 3:
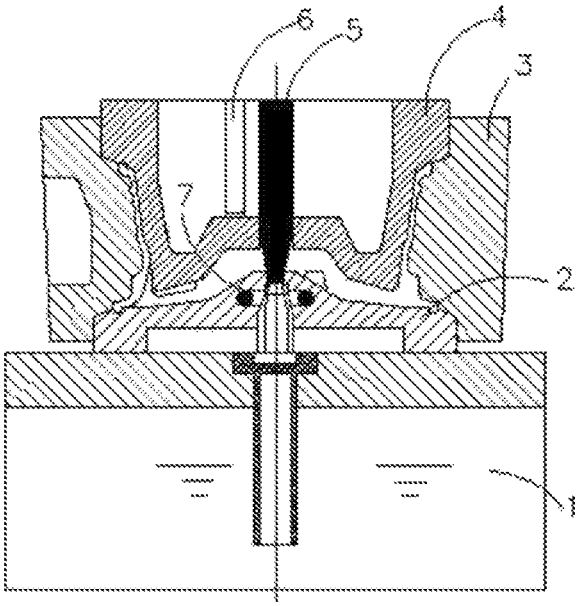
FIG. 3 is a schematic diagram of a stage at which the aluminum alloy at a center sprue is frozen to close the mold cavity after a center sprue spreader is lowered and a forced water cooler is started.
Figure 4:
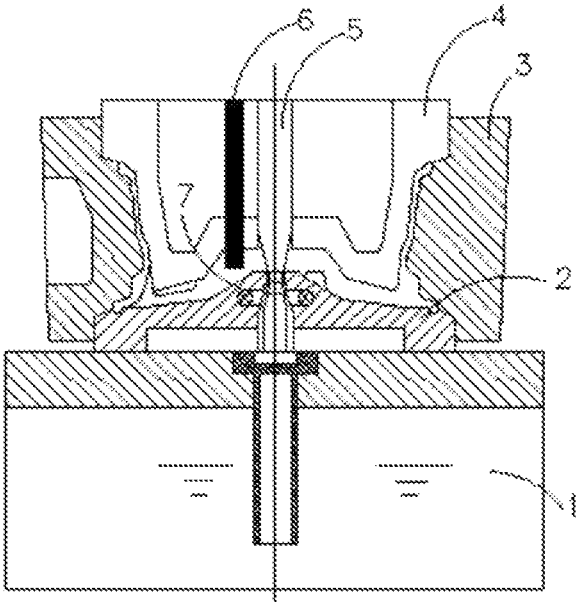
FIG. 4 is a schematic diagram of a stage at which the center extrusion rods are lowered to implement secondary pressure until the entire crystallization and solidification process of the aluminum wheel is completed.

As shown in FIG. 1 to FIG. 4, a low-pressure casting secondary pressure process for an aluminum wheel according to the present application includes low-pressure filling and secondary extrusion. In the low-pressure filling process, after the cavity is full of molten aluminum alloy and the rim is completely crystallized and solidified under delayed low-pressure holding pressure, a center sprue spreader 5 is lowered, a forced cold water cooling 7 is started, and a period of time is delayed to freeze the aluminum alloy at a center sprue 8 so as to close the mold cavity. In the secondary extrusion, center extrusion rods 6 are lowered for secondary pressurization to achieve extrusion deformation strengthened feeding, till the entire process of secondary pressurization for low-pressure casting of the aluminum wheel is completed.

According to the low-pressure casting secondary pressure process of the present application, the crystallization and solidification of the rim of the aluminum wheel are still completed under low-pressure casting holding pressure, so a low pressure holding delay stage should be set after the mold cavity is full of the molten aluminum alloy and before the center sprue spreader 5 is lowered to seal the low pressure in the holding furnace 1, in which the pressure holding time is between 10 and 15 seconds.

According to the low-pressure casting secondary pressure process of the present application, the center sprue spreader 5 is in clearance fit with the center sprue 8 with a clearance distance of 0.5 to 2 mm, preferably. In the present application, the clearance fit surface of the center sprue spreader 5 and the center sprue 8 is a tapered surface, and in order to facilitate de-molding, the tapered angle is between 0.5° and 5°.

According to the low-pressure casting secondary pressure process of the present application, the molten aluminum alloy at the center sprue spreader 5 and the center sprue 8 needs to be rapidly frozen under a forced water cooling condition to seal the mold cavity. Before the center extrusion rods 6 move down, a water cooling holding delay stage is set, and the delayed pressure holding time is between 15 and 20 seconds.

According to the low-pressure casting secondary pressure process of the present application, the maximum feeding pressure, acting on the molten aluminum alloy in the closed mold cavity, of the center extrusion rods 6 might reach 1000 times the pressure feeding capacity of ordinary compressed air in low-pressure casting.

The speed of lowering the center extrusion rods 6 is crucial to final molding and crystallization of the casting, and the lowering stage is divided into the first low speed and then high speed. Thus, no overflow flash is ensured for the casting, and forced pressure feeding is realized.

The lowering speed at the low-speed stage of the lowering process of the center extrusion rods 6 is 0.1 to 0.2 mm/s. The lowering speed at the high-speed stage of the lowering process of the center extrusion rods 6 is 0.5 to 0.7 mm/s.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A low-pressure casting secondary pressure process for an aluminum wheel, comprising low-pressure filling and secondary pressurization, a holding pressure is delayed for a period of time after a mold cavity is full of molten aluminum alloy under the low-pressure filling process, and the mold cavity is closed after a rim is completely solidified under low pressure feeding; wherein five center extrusion rods at corresponding positions of a wheel center of the aluminum wheel move down to apply mechanical pressure for secondary pressure feeding of the aluminum wheel to realize sequential solidification, until a forming process of crystallization and solidification of a casting is completed;

a low pressure holding delay stage should be set after the mold cavity is full of the molten aluminum alloy and before a center sprue spreader is lowered to seal the low pressure in a holding furnace, in which the pressure holding time is between 10 and 20 seconds;

the center sprue spreader is in clearance fit with a center sprue with a clearance distance of 0 to 2 mm; the clearance fit surface of the center sprue spreader and the center sprue is a tapered surface, and in order to facilitate de-molding, a tapered angle is between 0° and 5°;

before the center extrusion rods move down, a water cooling holding delay stage is set, and the delayed water cooling holding time is between 10 and 20 seconds;

a lowering stage of the center extrusion rods is divided into first low speed and then high speed, the lowering speed at the low-speed stage of the lowering process of the center extrusion rods is 0 to 0.2 mm/s, the lowering speed at the high-speed stage of the lowering process of the center extrusion rods is 0.5 to 0.8 mm/s, and the cross section diameters of the center extrusion rods are 50 mm.

2. The low-pressure casting secondary pressure process for an aluminum wheel according to claim 1, wherein the time of the low pressure holding delay stage set after the mold cavity is full of the molten aluminum alloy and before the center sprue spreader is lowered to seal the low pressure in the holding furnace is between 10 and 15 seconds.

3. The low-pressure casting secondary pressure process for an aluminum wheel according to claim 1, wherein the center sprue spreader is in clearance fit with the center sprue with a clearance of 0.5 to 2 mm; the clearance fit surface of the center sprue spreader and the center sprue is a tapered surface, and the tapered angle is between 0.5° and 5°.

4. The low-pressure casting secondary pressure process for an aluminum wheel according to claim 1, wherein the delayed water cooling holding time is between 15 and 20 seconds.

5. The low-pressure casting secondary pressure process for an aluminum wheel according to claim 1, wherein the lowering stage of the center extrusion rods is divided into first low speed and then high speed; the lowering speed at the low-speed stage of the lowering process of the center extrusion rods is 0.1 to 0.2 mm/s; and the lowering speed at the high-speed stage of the lowering process of the center extrusion rods is 0.5 to 0.7 mm/s.

* * * * *